United States Patent [19]

Buss

[11] Patent Number: 4,493,460

[45] Date of Patent: Jan. 15, 1985

[54] APPARATUS FOR DEPOSITING A WEB OF MATERIAL ON A TABLE

[75] Inventor: Albert Buss, Munsingen, Fed. Rep. of Germany

[73] Assignee: G. O. Stumpf GmbH & Co. Kommanditgesellschaft, Reutlingen, Fed. Rep. of Germany

[21] Appl. No.: 363,232

[22] Filed: Mar. 29, 1982

[30] Foreign Application Priority Data

Apr. 13, 1981 [DE] Fed. Rep. of Germany ..... 3114874

[51] Int. Cl.[3] ..... B65H 19/06; B65H 19/12; B65H 35/04

[52] U.S. Cl. ..... 242/58.6; 83/650; 83/925 CC; 242/68.4

[58] Field of Search ..... 242/58, 58.2, 58.6, 242/65; 83/649, 650, 925 CC; 242/67.3 R, 55.3, 68, 68.4

[56] References Cited

U.S. PATENT DOCUMENTS

| | | | |
|---|---|---|---|
| 846,962 | 3/1907 | Thayer | 242/68 |
| 1,009,827 | 11/1911 | Capers | 242/58 X |
| 1,363,441 | 12/1920 | Steele | 242/65 X |
| 1,793,180 | 2/1931 | Latham | 242/68.4 |
| 1,975,348 | 10/1934 | Cline | 242/58.2 |
| 2,258,358 | 10/1941 | Bostwick et al. | 242/65 |
| 2,558,903 | 7/1951 | Kastner | 242/58 X |
| 2,939,646 | 6/1960 | Stone | 242/58.2 |
| 2,941,742 | 6/1960 | Willis | 242/58 |
| 3,025,013 | 3/1962 | Harding et al. | 242/58.6 X |
| 3,450,364 | 6/1969 | Marsh et al. | 242/66 |
| 3,669,372 | 6/1972 | DeJong | 242/58.6 X |
| 3,675,868 | 7/1972 | Piattelli | 242/65 X |
| 3,823,629 | 7/1974 | Bleimund | 83/925 CC X |
| 4,176,566 | 12/1979 | Patterson et al. | 83/650 X |
| 4,419,913 | 12/1983 | Schutt et al. | 83/925 CC X |

FOREIGN PATENT DOCUMENTS

| | | |
|---|---|---|
| 1399649 | 12/1972 | United Kingdom . |
| 1532420 | 12/1975 | United Kingdom . |
| 2024884 | 6/1979 | United Kingdom . |
| 1017177 | 8/1983 | United Kingdom . |

*Primary Examiner*—Harvey C. Hornsby
*Assistant Examiner*—Scott J. Haugland
*Attorney, Agent, or Firm*—Scully, Scott, Murphy & Presser

[57] ABSTRACT

Material, such as fabric, is unwound from a bolt (7) in a magazine (6) and deposited on a table (1). The magazine (6) comprises a chain (8) having suspension elements (11, FIG. 2) for receiving spindles (10) of the bolts (7). The required bolt (7) is locked in an unwinding position and held firmly, but rotatably, by supporting means (14) and retaining means (18), all in the form of ball bearings. The bolt (7) is rotated by a drive element in the form of a friction wheel or a conveyor belt which drivingly engages either the periphery of the bolt (7) or the spindle (10). In FIG. 2, the drive element comprises a friction wheel (24) which is biased by a spring (25) into driving engagement with a further friction wheel (19) mounted on the spindle (10).

The apparatus enables the web to be deposited on the table free of tension.

4 Claims, 10 Drawing Figures

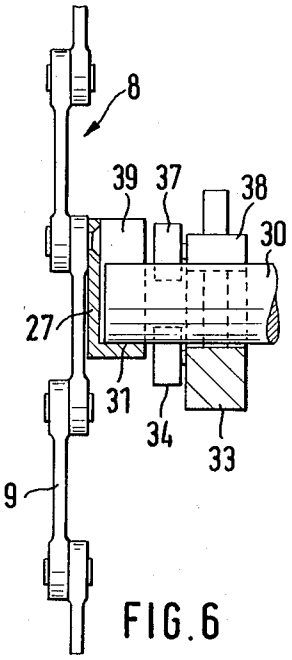
FIG. 6
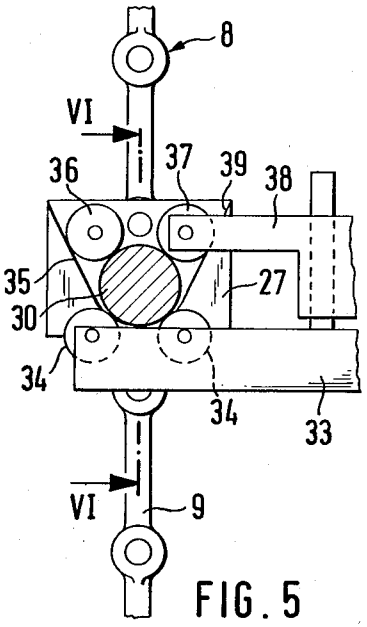
FIG. 5
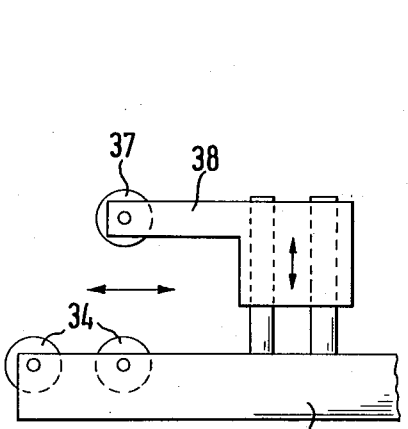
FIG. 4
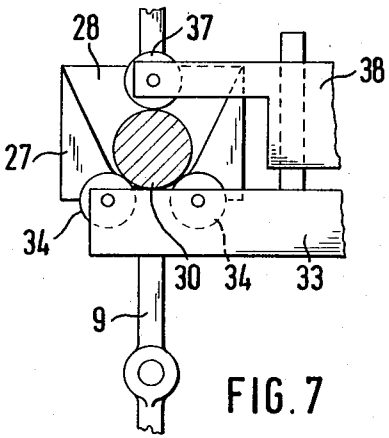
FIG. 7
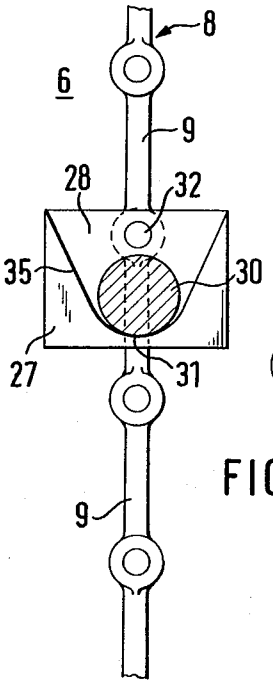

APPARATUS FOR DEPOSITING A WEB OF MATERIAL ON A TABLE

This invention relates to apparatus for automatically unwinding a web of material, such as fabric, from one of a plurality of bolts in a magazine, and depositing the web, free of tension, on a table.

Apparatus of this type is used to deposit webs of fabric onto the table for the purpose of cutting the web to size. Hitherto, the required bolt has been inserted in a fabric laying-out device from a stationary or portable magazine by means of a lifting-in device. The fabric is then deposited in the desired number of layers onto the table from the laying-out device. After a web has been laid out, the web can be severed from the bolt by an automatic cutting machine. Apparatus of this type has proved to be successful.

It is becoming increasingly common for only a few layers, or maybe even only one layer, to be required from each bolt at a time. This is true for ready-made clothes in sizes which are relatively uncommon or for ready-made clothes which are manufactured in small quantities for other reasons; so-called designer clothes. It has become apparent that a considerable length of time elapses between the preparation of the bolt of fabric and its untensioned deposition on the table, and also that complex operating stages have to be carried out automatically or semi-automatically. Expense arises because the bolt has to be removed from the magazine and inserted in the laying-out device and then, after the required number of layers has been laid out, the bolt must be returned to the magazine in the same way.

It is the object of the invention, therefore, to provide apparatus which will enable untensioned winding off and laying out of material to take place simply and quickly and hence economically.

According to one aspect of the present invention there is provided apparatus for unwinding a web from a bolt of material carried on a spindle supported movably in a magazine for movement into and out of an unwinding position, the apparatus comprising locking means for locking the spindle in the unwinding position and drive means which is adapted to act directly on the periphery of the bolt or on the spindle, when locked in the unwinding position, thereby to rotate the bolt to unwind the web from the bolt.

According to another aspect of the present invention there is provided apparatus for unwinding a web from a bolt of material which is supported in a magazine on an endless circulating element and for depositing the web on a table, the path of the circulating element including an undulating deflection which extends in a generally horizontal direction outwardly of the magazine over the table whereby a bolt at the outward extremity of the deflection is disposed vertically above the table, whereby rotation of the bolt in the appropriate direction causes the web to be deposited on the table, regardless of the direction in which the material is wound onto the bolt.

In embodiments in accordance with the present invention, the bolts can be driven either directly by acting on the periphery of the bolt, or indirectly by acting on the bolt spindle, whereby the web can be unwound and fed from the magazine and laid out on a table in an untensioned manner. The table can be rigid or it can be connected to a conveyor belt. A conveyor belt which is arranged in the table can also be provided. As a separate lifting-in device is not necessary, the entire unwinding and laying out process can proceed very rapidly. Furthermore, in some embodiments of the present invention, the fabric can be wound off of the bolt in either direction of rotation without there being any danger of the fabric not reaching the conveyor belt or the table. Because of this, when the bolt is inserted into the magazine, the direction of winding can be disregarded. Instead, it is sufficient to position the bolt which is disposed in the magazine relative to the magazine and/or the table and then to wind the fabric off the bolt. The magazine can be either stationary or mobile. In some embodiments, the fabric can be deposited on the table under gravity and consequently without tension. Some embodiments can be achieved by modifying existing magazines so that the advantages of the invention can be obtained even with existing installations wherein it is even possible to lay several layers by means of a conventional laying device if required.

For a better understanding of the present invention and to show how it may be carried into effect, reference will now be made, by way of example, to the accompanying drawings, in which:

FIG. 4 is a schematic view of part of a second embodiment of the equipment of FIG. 1;

Figure 1:
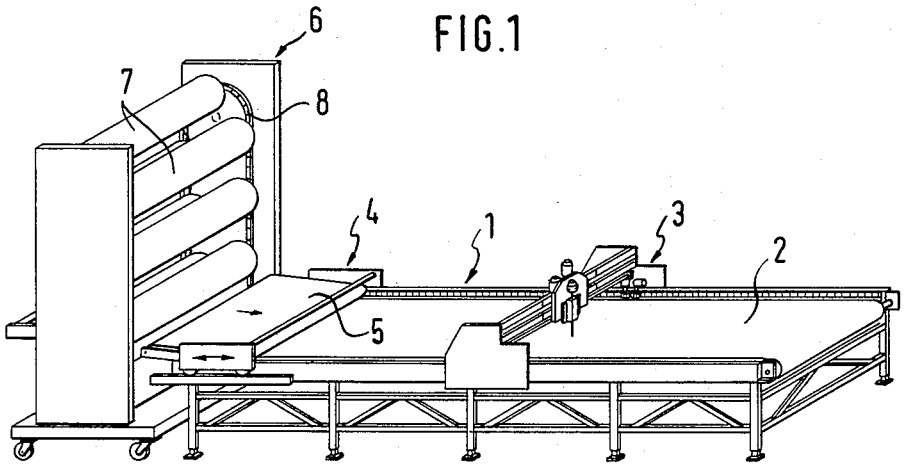
FIG. 1 shows fabric handling equipment comprising a laying table and a magazine carrying bolts of fabric.
Figure 9:
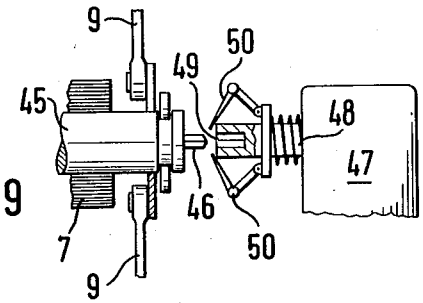
Figure 8:
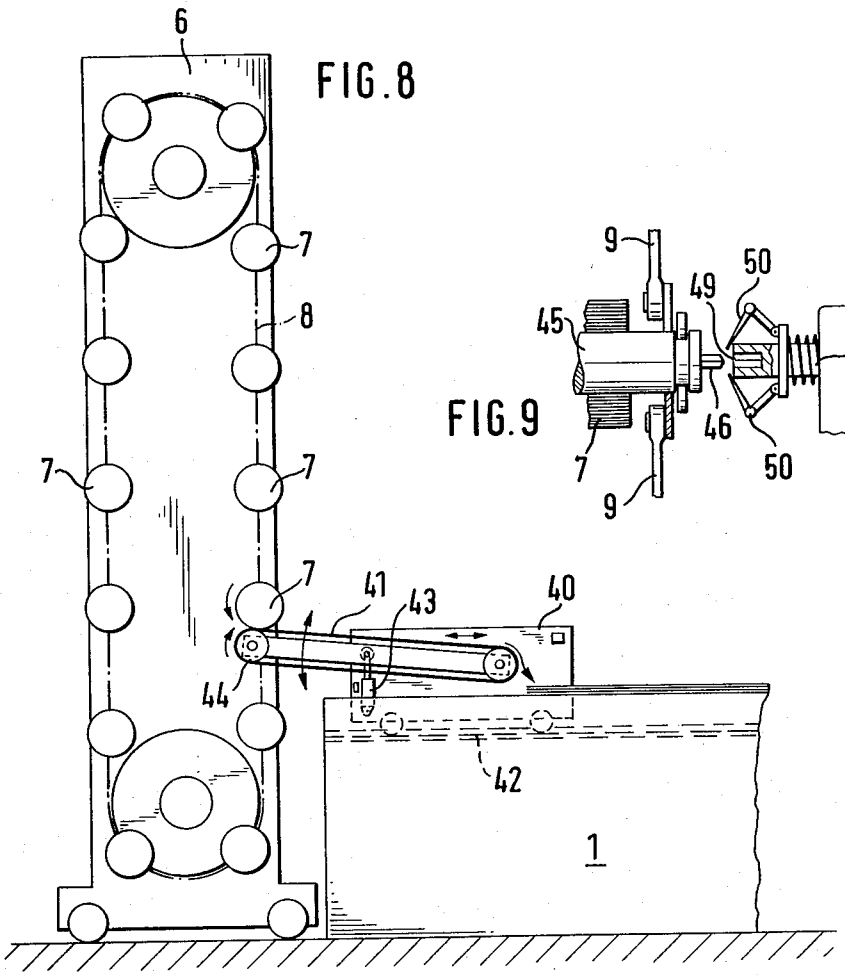

FIG. 5 corresponds to FIG. 4 but shows the equipment in a different operative condition;

FIG. 6 is a sectional view taken along the line VI—VI in FIG. 5;

FIG. 7 corresponds to FIG. 4 but shows an alternative construction;

FIG. 8 is a schematic side view of part of a third embodiment of the equipment of FIG. 1, including means for unwinding fabric from the bolts in the magazine;

FIG. 9 shows alternative means for unwinding fabric from the bolts; and

Figure 10:
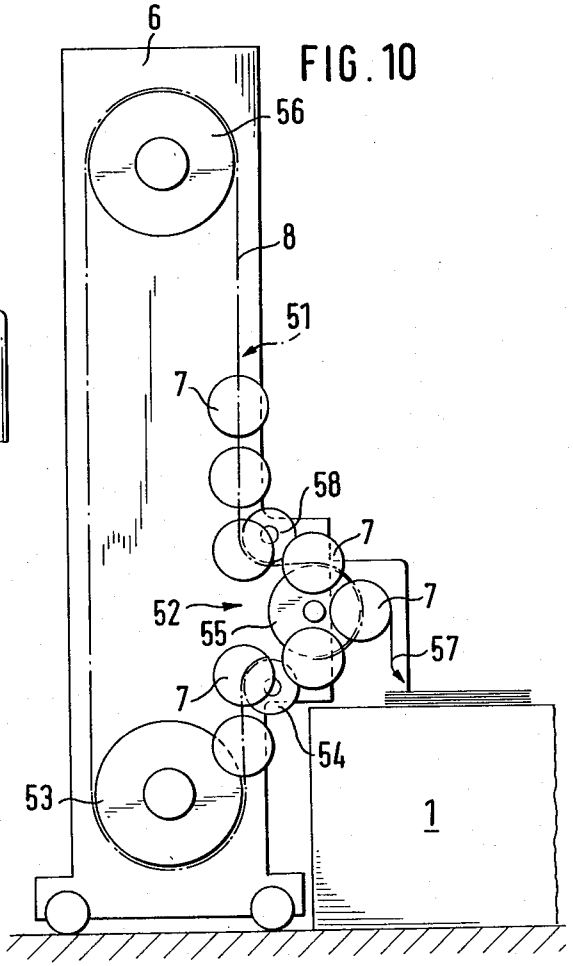

FIG. 10 corresponds to FIG. 8 but shows an alternative construction.

FIG. 1 shows the general arrangement of the type of equipment in which the present invention can be used. The equipment comprises a table 1 having a continuous laying belt 2, an automatic cutting device 3, a laying machine 4 which is capable of moving along the table 1 and which comprises a conveyor belt 5, and a feed magazine 6 comprising an endless chain 8 carrying several bolts 7 of fabric.

In the equipment shown in FIG. 1, the magazine 6 is constructed as an automatically movable transport and unwinding support for the bolts 7. However, it is also possible to use a magazine which is stationary with respect to the table 1.

In operation, fabric is wound off one of the bolts 7 and is deposited on the table 2 by the laying machine 4. Subsequently, the deposited fabric is cut out, following a pattern, by the cutting device 3, which may be automatically or manually guided.

Hitherto, equipment used to unwind fabric from a bolt and to lay it out on the table 1 is relatively complex in design and, particularly when only a single layer or only a few layers are to be unwound, is costly and uneconomical. This is because, for each fabric, a bolt 7 must be lifted out of the magazine 6 and inserted in the laying-out device, and it is then usually also necessary to thread through the fabric which is to be unwound.

This applies particularly to mobile magazines 6, and the magazine 6 has then to be positioned quite accurately with respect to the lifting-off device.

With the equipment to be described, highly accurate positioning is not necessary and where unwinding and untensioned depositing direct from the bolt 7 in the magazine 6 can take place quickly and therefore economically.

Figure 3:
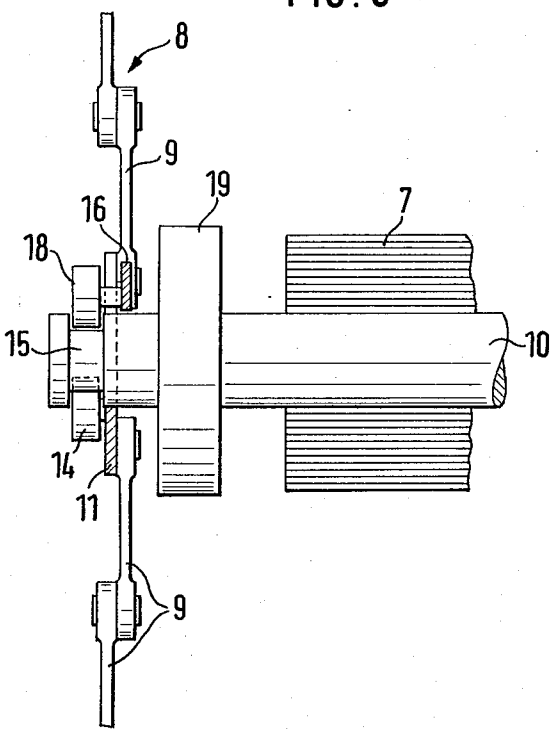
FIG. 3 is a sectional view taken along the line III—III of FIG. 2.
Figure 2:
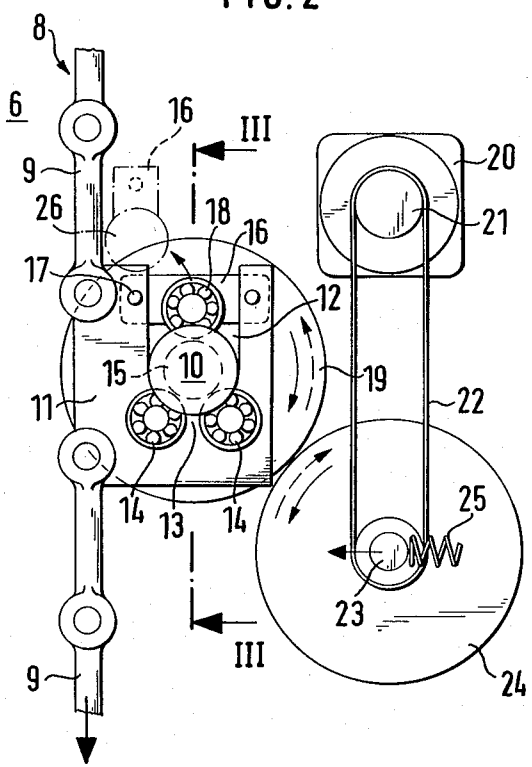
FIG. 2 is a side view of part of a first embodiment of the equipment of FIG. 1.

According to the embodiment represented in FIGS. 2 and 3, the magazine comprises a continuous chain 8 made up of links 9 of substantially the same length and design as each other, and of suspension elements for receiving the bolts 7. These suspension elements comprise brackets 11 for supporting spindles 10 of the bolts 7, each bracket 11 having a U-shaped recess 12 which is open at the top when the bracket is in the unwinding position. At the bottom region 13 of the recess 12 there is supporting means comprising two ball bearings 14, for the lower area of the spindle 10. The curved bottom region 13 of each recess 12 has a radius which is generally equal to the radius of the spindle 10. Improved axial retention of the spindle 10 can be achieved if the ball bearings 14 engage in a continuous annular groove 15 in the spindle 10. When the spindle 10 is in the recess 12, the recess 12 is closed by a releasable crosspiece 16. For example, the crosspiece 16 may be secured to the bracket 11 by bolts 17. However, the crosspiece 16 could alternatively be mounted permanently, but pivotably, on one side of the bracket 11. It is, however, essential for the closure of the recess 12 to prevent the bolt 7 from falling out of the recess 12 when the bracket 11 is upside down.

The crosspiece 16 carries retaining means, in the form of a ball bearing 18, for engagement with the upper region of the spindle 10, the ball bearing 18 also advantageously engaging in the groove 15.

In the embodiment shown, the spindle 10 is provided, at a position between the axial edge of the bolt 7 and the continuous chain 8, with a friction wheel 19. On the magazine 6 at a suitable point there is drive means 20, for example an electric motor, or even a manually rotatable arrangement. The output shaft 21 of the drive means 20 acting through a belt drive 22, causes a friction wheel 24 to rotate on a shaft 23. The friction wheel 24 is pressed, by means such as a spring 25, towards the continuous chain 8 so that the friction wheel 19 on the spindle 10 and the friction wheel 24 come into contact, as shown in FIG. 2.

When the friction wheels 19 and 25 are in contact, then by operating the drive means 20 either clockwise or anti-clockwise the fabric can be unwound from the bolt 7, irrespective of the direction of winding of the fabric on the bolt 7, and fed to the laying device 4, or, advantageously, directly to the conveyor belt 2 of the table 1 under gravity and therefore in an untensioned manner.

When unwinding of the required length of fabric from one bolt 7 is complete, the friction wheel 24 is moved against the force of the spring 25 to allow the continuous chain 8 to continue to bring another bolt 7 into the unwinding position so that its friction wheel 19 can come into contact with the friction wheel 24. The continuous movement of the chain 8 can be effected automatically using a schematically represented sensor 26.

It has been found that particularly accurate positioning of the spindle 10 and the friction wheel 19 thereof relative to the friction wheel 24 is not necessary. It is sufficient to ensure that there is definite contact between friction wheels 19 and 24. For this, the arrangement of the ball bearings 14 and 18 is chosen so that within the possible deviations in the mutual position of the friction wheels 19, 24 the spindle 10 always runs on the ball bearings 14, 18.

The unwinding arrangement 20 to 25 does not have to be mounted on the magazine 6, but can also be arranged in a stationary manner relative to the table 1, the magazine 6 then being moved forward. The operating principle, however, remains the same. The bolt 7 from which the web is to be unwound is locked, for unwinding purposes, relatively to the table 1 in the position wherein the bolt 7 is then set in rotation by an unwinding device so that the fabric can be taken from the bolt 7 and deposited on the table 1.

FIGS. 4 to 7 show embodiments wherein carriages 27 with generally parabolic recesses 28 are pivotally mounted on the chain 8 which consists of links 9. The carriages 27 are mounted on the chain 8 in such a way that the vertex 31 of the parabolic recess 28 for receiving the spindle 30 of the bolt is always vertically below the point at which the carriage 27 is attached to the continuous chain 8. The attachment point is advantageously, as in the embodiment shown, the interconnection 32 of two adjacent links 9. When the spindle 30 is suitably positioned relatively to the table 1 (not shown), the chain 8 is arrested, for example by a control using a sensor corresponding to the sensor 26 of FIG. 2.

In order to unwind the fabric from the bolt on the spindle 30 by means of an appropriate drive such as the friction wheel drive of FIGS. 2 and 3 or another type of drive such as will be described later, the spindle 30 must be locked in position. A locking device for this purpose comprises an arm 33 having, on its front end, supporting means in the form of two ball bearings 34 corresponding to the ball bearings 14 of FIG. 2 for the lower region of the spindle 30. The arm 33 is movable in a generally horizontal direction into the path of the continuous chain 8 so that the centre line between the ball bearings 34 can reach a position approximately vertically below the axis of the spindle 30. The spindle 30 runs counter to the ball bearings 34 so that it can run freely thereon.

If a rotary drive means acts on the spindle 30 or directly on the bolt itself and exerts thereon a force component which acts vertically upwards, then retaining means for the upper region of the spindle 30, comparable to the ball bearing 18 in FIG. 2, has to be provided. This may comprise, as shown in FIG. 5, a ball bearing 36 mounted in the carriage 27 close to the parabolic flank 35 which is away from the arm 33, and another ball bearing 37 which is mounted on a contact pressure arm 38 which is movable generally vertically relative to the horizontally movable arm 33 and which, by moving downwards, as shown in FIG. 5, comes into contact with the spindle 30 in the region of the other parabolic flank 39.

In the embodiment shown in FIG. 7, the contact pressure arm 38 is constructed so that the ball bearing 37 which is secured to its end is movable along the centre line between the two ball bearings 34 and therefore vertically relative to the axis of the spindle 30.

From the bolt on the spindle 30, which is thus locked in position, the fabric can be unwound, for example by means of the friction wheel drive of FIGS. 2 and 3. The locking in device 33, 34, 37, 38 can be secured to the magazine, or alternatively it can be arranged in a stationary manner relative to the table 1.

As with the embodiment of FIG. 3, the spindle 30 can be provided with a continuous groove, corresponding to the continuous groove 15 of the spindle 10, for receiving the ball bearings 34, 37.

FIG. 8 shows an embodiment in which the fabric is unwound from the bolt 7 not by a friction wheel drive as in FIG. 2, but by a conveyor belt 41 mounted on a carriage 40 which is movable relatively to the table 1. With the bolt 7 locked in position, for example as described for the embodiments described above, the carriage 40 is moved on rails 42 mounted on the table 1 into the path of the continuous chain 8 below the bolt 7 which is to be unwound, and is pressed by means of a pivoting device such as a cylinder-piston arrangement 43 against the bolt 7 or advantageously against a friction wheel mounted on the spindle of the bolt and having a larger diameter than the bolt 7. Subsequently, the conveyor belt 41 is set in motion so that the conveyor guide 44 adjacent the bolt 7 and the magazine 6 moves the conveyor belt 41 from its bottom run to its top run so that the fabric which is wound in the opposite direction thereto comes to rest on the conveyor belt 41 and is deposited by it on the table 1. The carriage 40 can be combined with the laying device 4, or alternatively can be independent of it. Finally, the conveyor belt, on which the unwound fabric comes to rest, can differ from the conveyor belt 41 which sets the bolt 7 in rotation. The latter can be, for example, a continuous belt which only comes into contact with the friction wheel referred to on the spindle of the bale of fabric. With conveying devices which are controllable in a different way, bolts 7 with different winding directions can be unwound.

FIG. 9 shows a different means for rotating the spindle 45 of the bolt 7 which is supported by the continuous chain in one of the ways referred to above and which is locked in position. In the embodiment of FIG. 9, the spindle 45 has a non-circular, for example, square, projection 46. A drive mechanism 47 is mounted on the magazine 6 or alternatively is stationary relative to the table 1 and has an output shaft 48 which is axially movable and has a square recess 49 which corresponds to the square projection 46. Of course, an alternative possibility would be to provide the projection on the output shaft 48 and the recess in the spindle 45. In either case, comparatively accurate, axial alignment of the projection 46 relative to the recess 49 is necessary. This can be achieved, for example, by means of one or two schematically represented position sensors 50 so that, if necessary, the axially movable shaft 48 of the drive mechanism 47 is axially displaced to enable the projection 46 to enter the recess 49, and subsequently the drive mechanism 47 is operated to rotate the spindle 4 and thereby to wind the web off the bolt 7.

FIG. 10 shows an embodiment with which the fabric is wound off above the table 1, and consequently direct, untensioned depositing on the table 1 is possible. The path 51 of the continuous chain 8 of the magazine 6 has an undulating deflection 52 extending in a generally horizontal direction outwardly of the magazine 6. For this purpose there is provided in the circulation path 51, close to the usual lower deflecting roller 53, a small deflecting roller 54 which is arranged so that horizontally deflected bolts 7 carried by the continuous chain 8 can be moved at a high level located safely above the table 1, yet close thereto. Near the extreme projecting end of the deflection 52 there is a centre deflecting wheel 55 around which the continuous chain 8 with the bolts 7 is guided. The continuous chain 8 passes from this centre deflection roller 55 over the usual upper, large deflection roller 56, although it is also possible, as illustrated, to provide a further, small deflecting roller 58 in order to make the deflection 52 generally symmetrical about a horizontal plane. The fabric is unwound from the bolt 7 whose axis (or whose spindle axis) is substantially in the same horizontal plane as the axis of rotation of the centre deflection wheel 55, so that when the bolt 7 or the spindle rotates after having been locked in position, the fabric which is wound off can be deposited on the table 1 directly under gravity in an untensioned manner as indicated by the arrow 57. Each of the rotary drives shown, with the exception of that of FIG. 8, is suitable for driving the spindle, but that of FIG. 9 should be very appropriate here as it is possible to achieve relatively accurate positioning of the spindle. When the deflection 52 extends in an appropriate horizontal manner, depositing can take place by appropriate control of the rotary drive, regardless of the direction of winding of the bolt 7.

Furthermore, a rotary drive wherein the spindle of the bolt is provided not with a friction wheel but solely with a friction lining is also, in principle, possible for all the embodiments. In the embodiment of FIGS. 2 and 3, this would simply means that the friction wheel 24 must have a larger diameter.

Furthermore, it is also possible for one or more of the supporting means 34, 37 of the spindle 30 in the embodiment of FIGS. 4 and 7 to be automatically driven, so making any further rotary drive unnecessary.

The embodiments described above provided simple, economical apparatus with which even a single layer or a few layers of fabric or other sheet material can be automatically unwound directly from bolts in a magazine. The magazine may be either stationary relative to the table or mobile. At least some of the embodiments can be used as adaptations of existing equipment. In all of the embodiments, the bolt from which fabric is to be unwound is first locked in position relative to the table and/or the magazine, and a winding-off device, which cooperates with the position-locking device and which acts either on the periphery of the bolt or on the spindle of the bolt, winds off the fabric from the bolt and deposits the fabric on the table advantageously under gravity in an untensioned manner. It is sufficient for the majority of embodiments for the spindle to be inserted with its ends in holes provided in endless elements circulating in the magazine, for example in bracket holes of continuous chain elements.

I claim:

1. Apparatus for allowing the untensioned unwinding off and laying out of a web from a bolt of material carried on a spindle, comprising:

a. a cutting table on which the untensioned web is to be deposited for a cutting operation thereon;

b. a magazine, positioned adjacent to said cutting table, for movably supporting a plurality of bolts of web for movement of any one bolt in the magazine into and out of a common unwinding position, said magazine comprising a pair of side endless drive elements, with each side drive element being formed by an endless series of articulated elements which support at intervals therealong suspension elements for supporting the ends of each bolt of material, supporting the spindle for movement of the bolt into and out of an unwinding position, each suspension element comprising a bracket, a recess in said bracket for receiving the spindle of the bolt, said recess having an open top and a closed bottom, supporting means provided in the bottom of the recess for supporting the end of a bolt of material, said supporting means comprising two bearings which are spaced apart by a distance which is less than the diameter of the bolt spindle, a cross-piece releasably secured to the bracket to close the top of the recess, and retaining means mounted on the crosspiece;

c. locking means for locking the spindle in the unwinding position; and d. a common drive means, acting directly on the periphery of the bolt or on the spindle, when locked in said unwinding position, to rotate the bolt to unwind the web from the bolt.

2. Apparatus as claimed in claim 1, in which the retaining means comprises a bearing.

3. Apparatus for allowing the untensioned unwinding off and laying out of a web from a bolt of material carried on a spindle, comprising:

a. a cutting table on which the untensioned web is to be deposited for a cutting operation thereon;

b. a magazine, positioned adjacent to said cutting table, for movably supporting a plurality of bolts of web for movement of any one bolt in the magazine into and out of a common unwinding position, said magazine comprising a pair of side endless drive elements, with each side drive element being formed by an endless series of articulated elements which support at intervals therealong suspension elements for supporting the ends of each bolt of material, supporting the spindle for movement of the bolt into and out of the unwinding position;

c. locking means for locking the spindle in the unwinding position; and d. a common drive means, acting directly on the spindle, when locked in said unwinding position, to rotate the bolt to unwind the web from the bolt, said bolt spindle comprising a friction area, and the drive means comprising a carriage which is movable relative to the table, and a rotatable drive element for driving engagement with said friction area, said rotatable drive element comprising a conveyor belt mounted on the carriage for movement therewith to bring the conveyor belt into driving engagement with said friction area of the bolt spindle.

4. Apparatus as claimed in claim 3, in which a friction wheel is mounted on the bolt spindle and the conveyor belt is adapted to engage drivingly the lower region of the friction wheel and to receive material unwound from the bolt.

* * * * *